US005302218A

United States Patent [19]

Shirai et al.

[11] Patent Number: 5,302,218

[45] Date of Patent: Apr. 12, 1994

[54] SURFACE REFORMING METHOD OF ALUMINUM ALLOY MEMBERS

[75] Inventors: Kazuhiko Shirai; Masaru Takatoo, both of Hiroshima, Japan

[73] Assignee: Mazda Motor Corporation, Hiroshima, Japan

[21] Appl. No.: 948,411

[22] Filed: Sep. 22, 1992

[30] Foreign Application Priority Data

Sep. 24, 1991 [JP] Japan ..... 3-243162

[51] Int. Cl.[5] ..... C22F 1/04

[52] U.S. Cl. ..... 148/695; 29/90.01; 29/90.7; 72/53; 72/76; 148/552; 148/696; 148/697

[58] Field of Search ..... 148/695, 696, 697, 552; 29/90.01, 90.7; 72/53, 76

[56] References Cited

U.S. PATENT DOCUMENTS 3,469,433 9/1969 Fresch et al. ..... 148/695

3,531,337 9/1970 Kawakatsu ..... 148/552

FOREIGN PATENT DOCUMENTS 1-208415 8/1989 Japan .

*Primary Examiner*—R. Dean

*Assistant Examiner*—Robert R. Koehler

*Attorney, Agent, or Firm*—Sixbey, Friedman, Leedom & Ferguson

[57] ABSTRACT

An aluminum alloy member is heated to 470°-550° C., and is quenched to room temperature for hardening. Then the aluminum alloy member is heated to 160°-220° C., and is cooled, which is carried out in a cooling process of a tempering treatment. As the aluminum alloy member is in a softening state in the cooling process, plastic working such as shot peening treatment is performed on the surface of the aluminum alloy member. Thereafter, the temperature of the aluminum alloy member falls to room temperature. In this way, it is possible to generate a great amount of compression residual stress in the aluminum alloy member, without performing a severe plastic working treatment on the surface thereof. Since the present invention requires no severe plastic working treatments on the surface of the aluminum alloy member, this causes no severe surface roughness thereon.

4 Claims, 4 Drawing Sheets

SURFACE REFORMING METHOD OF ALUMINUM ALLOY MEMBERS

BACKGROUND OF THE INVENTION

This invention relates to a surface reforming method for reforming the surface of an aluminum alloy member to improve its fatigue strength without causing damage to surface roughness.

In recent years, there is a demand for lightweight automobiles, which requires many aluminum alloy members to be used as the reinforcement member in a lightweight vehicle. Various attempts to improve the fatigue strength (durability) of aluminum alloy members have been made, accordingly. For example, this problem is approached by the improvements of alloy ingredients or heat treatments of the aluminum alloy member.

There is meanwhile a technique known as plastic working wherein compression residual stress is generated on the surface of an aluminum alloy member to improve its fatigue strength. Among a variety of plastic working, shot peening treatment is regarded as one of the effective methods for generating compression residual stress available for the improvements of fatigue strength.

The conventional shot peening treatments of generating compression residual stress on the surface of an aluminum alloy member have been carried out at room temperature. To improve the fatigue strength of the aluminum alloy member by compression residual stress, various studies have been made not only on the quality and particle size of shot members, but also on the conditions of the shot peening treatment such as shot peening pressure.

A hard shot peening treatment may not be applicable to members such as aluminum alloy members having a low strength along with a high brittleness because of the occurrence of rough surface and surface peeling. Due to these disadvantageous effects, it has been difficult to generate a high compression residual stress on the surface of the aluminum alloy member.

An aluminum alloy member, namely JIS-AC4C (Al-Si-Mg) is treated through a shot peening treatment at room temperature in the arc height range of 0.05 mm to 0.4 mm. FIG. 6 shows the relationship between the compression residual stress caused by the shot peening treatment and the resulting surface roughness of the aluminum alloy member (i.e., JIS-AC4C (Al-Si-Mg)).

As shown in FIG. 6, for the shot peening treatment carried out at room temperature, the surface of the aluminum alloy member tends to become rougher with the increase of the compression residual stress, or the arc height. In other words, the generation of high compression residual stresses to obtain a superior fatigue strength inevitably leads to the occurrence of a severe rough surface.

Japanese published Patent Application 1-208415 discloses a technique relating to plastic working such as shot peening treatment. In accordance with this prior technique, the surface of a casting is rapidly molten and then is rapidly resolidified, thereafter the resolidified surface being treated by a shot peening treatment. This prior art, however, has a drawback in the application to aluminum alloy members. Since aluminum alloy members have a good thermal conductivity, it is difficult to equalize the thickness of resolidified layers which are formed in the processes of rapid melting and re-solidification. Additionally, the occurrence of rough surface described above cannot be avoided because the shot peeing treatment of the resolidified layer is carried out after a cooling process.

SUMMARY OF THE INVENTION

The present invention was made to solve the foregoing problems. It is therefore an object of the invention to provide a method for improving the fatigue strength of aluminum alloy members while at the same time preventing the occurrence of rough surface.

With a view to achieving the above object, the surface reforming method of an aluminum alloy member in accordance with the invention comprises the steps of:

(1) performing a plastic working treatment on the surface of the aluminum alloy member at its softening temperature where it becomes softened, and (2) lowering the temperature of the aluminum alloy member which has already undergone the plastic working treatment down to room temperature.

With the plastic working treatment described above, the aluminum alloy member is in a softening state, and the crystals of the aluminum alloy member is in an expanding state. Strains can be easily put to the crystals that are in such an expanding state. Such strains practically become compression residual stresses. Accordingly, a high compression residual stress can be generated in the aluminum alloy members without carrying out an intense plastic working treatment. Additionally, as no intense plastic working treatments are performed on the aluminum alloy member, there will occur no serious roughness on its surface.

When the temperature of the aluminum alloy member treated by the plastic working treatment falls to room temperature, the compression residual stress of the aluminum alloy member increases. Since a high compression residual stress is generated in the aluminum alloy member as its temperature has fallen to room temperature, the fatigue strength can be improved without causing rough surface.

The use of a shot peening treatment, as a plastic working treatment, is preferable, since the shot peening treatment facilitates plastic working even if an aluminum alloy member to be surface reformed has an intricate form. In addition, with the shot peening treatment, high compression residual stresses can be generated, and further the compression residual stresses being generated can be controlled easily because of the easy controllability over the strength of plastic working.

It is preferable that the temperature of the aluminum alloy member to be treaded by the plastic working treatment is in the 50°–125° C. range (i.e., not less than 50° C. and not more than 125° C.). A plastic working treatment carried out within such a temperature range produces a much higher compression residual stress compared to the one carried out at room temperature. In fact, the produced compression residual stress is more than doubled.

If the arc height of the shot peeing treatment is within the 0.025–0.125 mm range, the fatigue strength is sufficiently improved and cracking can be avoided.

It is preferably that the temperature of the aluminum alloy member in performing the plastic working treatment is obtained at a cooling process of a tempering treatment in a solution treatment. The solution treatment is frequently carried out on aluminum alloy members, therefore, if the plastic working treatment is carried out at the cooling process, there will be no need to reheat the aluminum alloy members as they cool down to room temperature.

DETAILED DESCRIPTION OF THE INVENTION

Various experiments made by the inventors in the course of accomplishing the present invention are described prior to the descriptions of embodiments of the invention.

In the first place, a casting of an aluminum alloy member (JIS-AC4C (Al-Si-Mg)) was made, which was then treated under JIS-T6 treatment (that is, was treated first by a solution treatment and next by an artificial age hardening treatment). In this way, a sample was obtained. With gradually keeping this sample within the temperature range from 20° to 150° C., respective shot peening treatments (the arc height=0.05 mm) were performed on the sample at each temperature.

Figure 1:
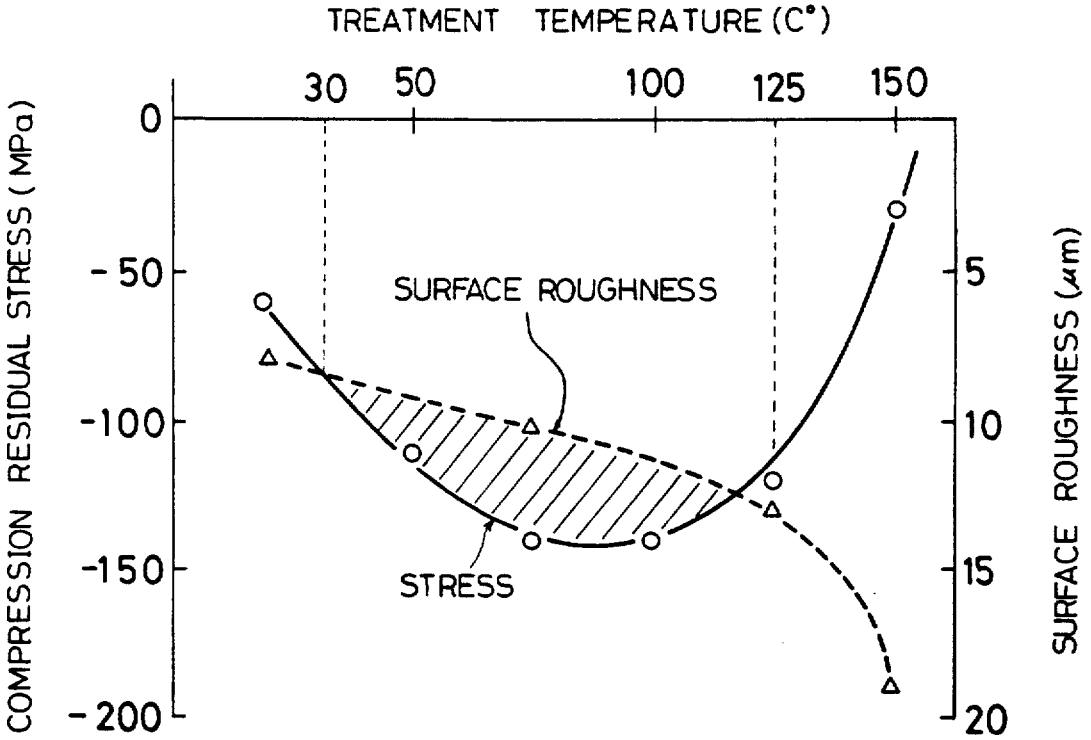
FIG. 1 is a graph showing the relation between the temperature of an aluminum alloy member when carrying out the shot peening treatment, the compression residual stress and the surface roughness.

FIG. 1 shows the relation between the temperature of the sample and the produced compression residual stress and further shows the relation between the temperature of the sample and the surface roughness of the sample, in the above-described shot peening treatments.

As clearly seen from FIG. 1 (the temperature of the sample against the produced compression residual stress), as the temperature of the sample is raised above 20° C., the compression residual stress produced becomes higher. At about 75°-100° C., the highest compression residual stress appears. After the temperature moves up to 150° C., the compression residual stress drops off sharply, which may be caused by the fact that the aluminum alloy member is significantly softened at that temperature.

As shown in FIG. 1, the shot peening treatment (the arc height=about 0.05 mm; the temperature of a sample=30° C.) allows the compression residual stress to increase by 50 percent compared to that obtained by the treatment made at room temperature. Accordingly, the shot peening treatment proves to be effective if it carried out when the temperature of the sample is within the 30°-125° C. range where the aluminum alloy member is in a softening state.

Further, FIG. 1 shows the relation between the temperature and the surface roughness of the sample, from which it is understood that the surface roughness increases as the temperature rises. The shot peening treatment produces different surface roughness at different temperatures. At room temperature the surface roughness is about 8 μm, at 125° C., about 13 μm and at 150° C., about 19 μm.

Generally judging from the relation between the shot peening treatment temperature, the compression residual stress, and the surface roughness, the suitable temperature of the aluminum alloy member for generating a sufficient amount of compression residual stress without causing a serious surface roughness to take place is found in the range of 30° C. to 125° C.

It is most preferable to carry out the shot peening treatment when the temperature of the aluminum alloy members is in the range of 50° C. to 125° C., since the more than doubled compression residual stress, compared to the shot peening treatment carried out at room temperature, can be obtained.

Next, a casting made of an aluminum alloy member (JIS-AS4C (Al-Si-Mg)) was obtained. While keeping the temperature of the casting at 125° C., the shot peening treatment was made thereon. With regard to this, FIG. 2 shows the relation between the shot peening treatment condition and the compression residual stress.

Figure 2:
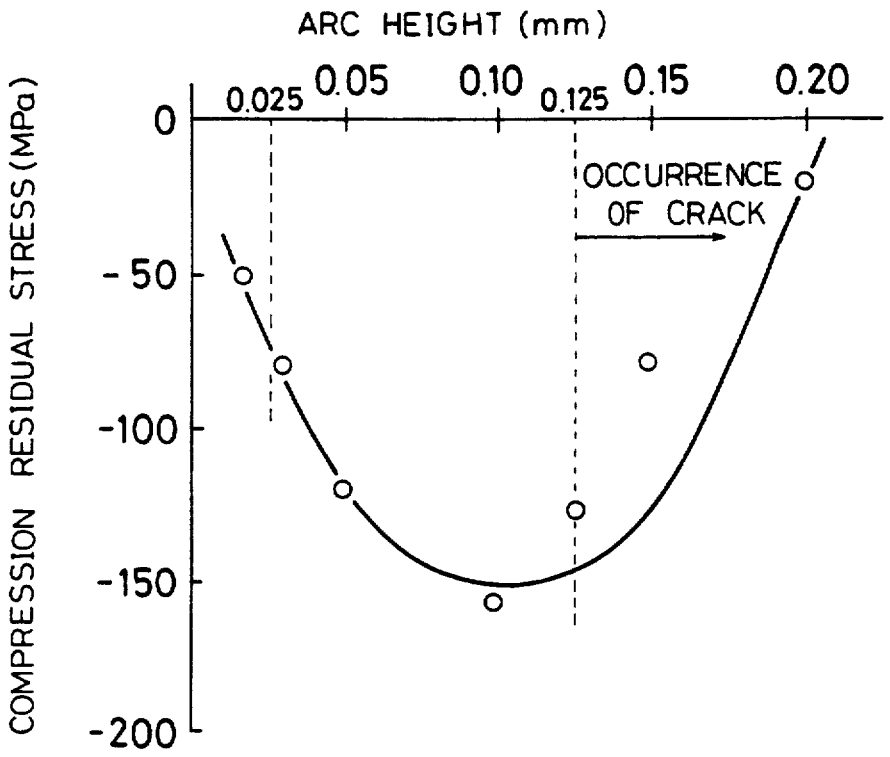
FIG. 2 is a graph of the compression residual stress versus the arc height in the shot peening treatment.

As seen from FIG. 2, the compression residual stress proportionally increases with the increase of the arc height from about 0.01 mm up to about 0.10 mm. Conversely, the compression residual stress decreases if the arc height is beyond 0.10 mm.

Particularly, if the arc height exceeds 0.125 mm, cracking will occur on the surface of the aluminum alloy member. That is, if the arc height is beyond a certain point, cracking occurs and the compression residual stress falls, the reason for which is presumed such that the plasticity of an aluminum alloy member which is of a high temperature is yielded due to the impact caused by the shot peening treatment.

The compression residual stress available for the improvement of fatigue strength can be obtained if the arc height is not less than 0.025 mm, while the cracking can be avoided if the arc height is not more than 0.125 mm. Thus the preferable range of the arc height is 0.025-0.125 mm, in the shot peening treatment that is applied to the aluminum alloy member whose temperature is above room temperature.

Figure 3:
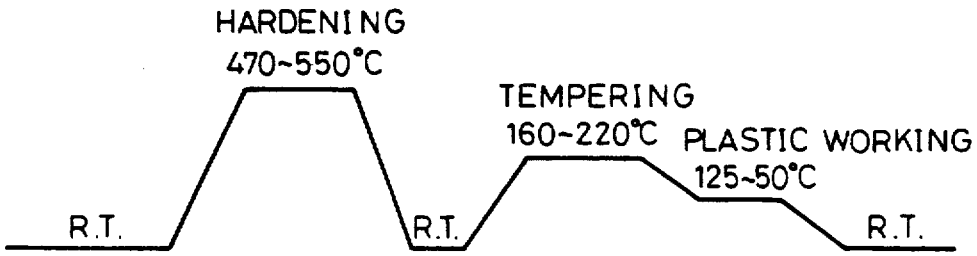
FIG. 3 illustrates the temperature-variation in the surface reforming method of the aluminum alloy member in accordance with an embodiment of the present invention.

Now referring to FIG. 3, an embodiment of the present invention based on the foregoing experiments will be described below.

A reinforcement member used for automobiles is cast from an aluminum alloy member (JIS-AC4C (Al-Si-Mg)). As shown in the phase diagram of FIG. 3, the reinforcement member is surface reformed.

The reinforcement member is kept at 470°-550° C. in a furnace for 3-5 hours, and then is water quenched for hardening. After the temperature of the reinforcement member falls to room temperature (referred to as "R.T." in the figure), it is again kept at 160°-220° C. for 5-7 hours. Then the reinforcement member is cooled down for tempering. This combination of the hardening and the tempering described above is known as a solution treatment.

When the temperature of the reinforcement member falls from 160°-220° C. down to 50°-125° C. during the cooling process of the forging tempering treatment, the plastic working treatment is carried out for reforming the surface of the reinforcement member.

In the embodiment, the preferable temperatures ranging from 50° to 125° C. are obtained during the cooling process of the tempering treatment, however, it may be possible to heat the reinforcement member, the temperature of which has fallen to room temperature, up to 50°-125° C. and then to have it undergo the plastic working.

The shot peening treatment was selected from among a variety of plastic working treatments and was carried out because of the form of the reinforcement member to be surface reformed, the value of the produced compression residual stress, and the ease of the control over the development zone of the compression residual stress. Then the arc height used in the shot peening treatment was 0.05 mm.

Under a condition that the temperature of the reinforcement member is 100° C. and the arc height is 0.05 mm, the shot peening treatment was carried out. The surface of the reinforcement member did not become rough. The compression residual stress measured when the temperature of the reinforcement member fell to room temperature was about twice to three times greater than that measured when the temperature of the reinforcement member was 100° C.

Figure 4:
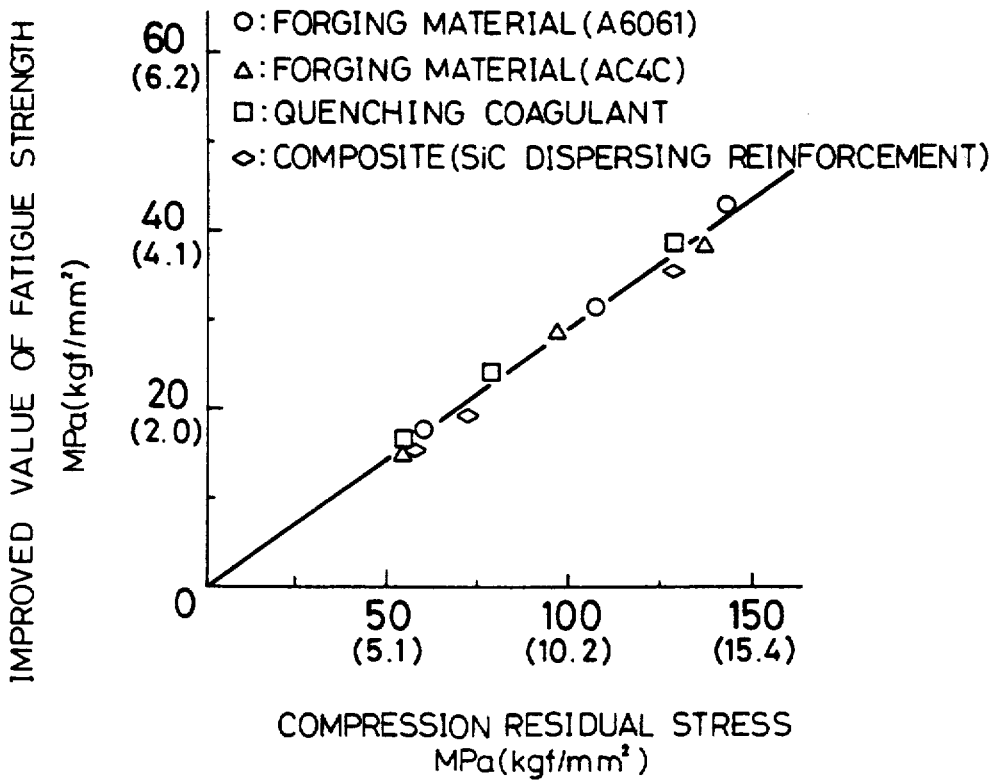
FIG. 4 is a graph showing the relation between the compression residual stress of the aluminum alloy member and the improved value of the fatigue strength.

Irrespective of forged members, cast members, quenching coagulant of powder metallurgy or SiC dispersing reinforcement composites, the state of change of the composition of the aluminum alloy member showed the same tendency. It is particularly shown in FIG. 4 that there is a linear relationship between the compression residual stress produced on the surface of the aluminum alloy member and the improved value of the fatigue strength. It is known that fatigue strength becomes greater as compression residual stress increases.

In accordance with the present invention, even if plastic working such as shot peening treatment is applied to an aluminum alloy member that is in its softening state, to such an extent that the surface thereof is not roughened and the surface peeling is prevented from occurring, a superior fatigue stress can be obtained without causing damage to the surface because the compression residual stress increases as the temperature of the aluminum alloy member falls from its softening temperature down to room temperature.

Examples of the present invention will be described below.

A reinforcement member used for automobiles suspension section is cast from an aluminum alloy member (JIS-AC4C (Al-Si-Mg)). Then the reinforcement member was kept at 530° C. for 4 hours, as JIS-T6 treatment (an artificial age hardening treatment after a solution treatment), and was water quenched for hardening. The reinforcement member was kept at 180° C. for 6 hours, and then was cooled in an atmosphere of vapor for tempering.

In the cooling process of this tempering treatment, the following plastic working treatments were carried out respectively against the reinforcement member in the 100°-125° C. range within which it (the reinforcement member) is in its softening state.

EXAMPLE 1

In Example 1, the shot peening treatment was carried out under a condition, that is, the temperature = 100° C. and the arc height = 0.025 mm.

EXAMPLE 2

In Example 2, the shot peening treatment was carried out under a condition, that is, the temperature = 125° C. and the arc height = 0.05 mm.

EXAMPLE 3

In Example 3, the shot peening treatment was carried out under a condition, that is, the temperature = 125° C. and the arc height = 0.1 mm.

EXAMPLE 4

In Example 4, the rolling process was carried out 30 times under a condition, that is, the temperature = 100° C., the surface pressure = 70 Kg, and the rotational speed = 40 r.p.m. The rolling process made at 100° C. caused the compression residual stress to increase by around 40 percent compared to that made at room temperature.

In accordance with the shot peening treatments of Examples 1, 2 and 3, the surface roughness of the reinforcement member, which had been surface finished by grinding to a surface roughness of 3 μm, was maintained to fall in the range of 6 to 13 μm.

In the rolling process of Example 4, there occurred the peeling on the surface of the reinforcement member when the surface pressure was above 70 Kg.

Figure 5:
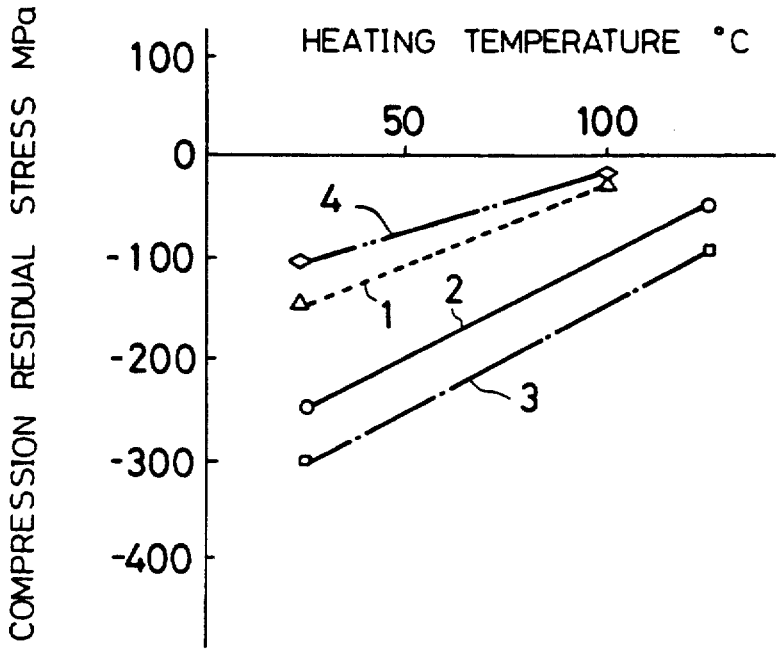
FIG. 5 shows that the compression residual stress, produced by the plastic working treatment, increases as the temperature of the aluminum alloy member falls from a temperature at which the treatment is carried out, down to room temperature.
Figure 6:
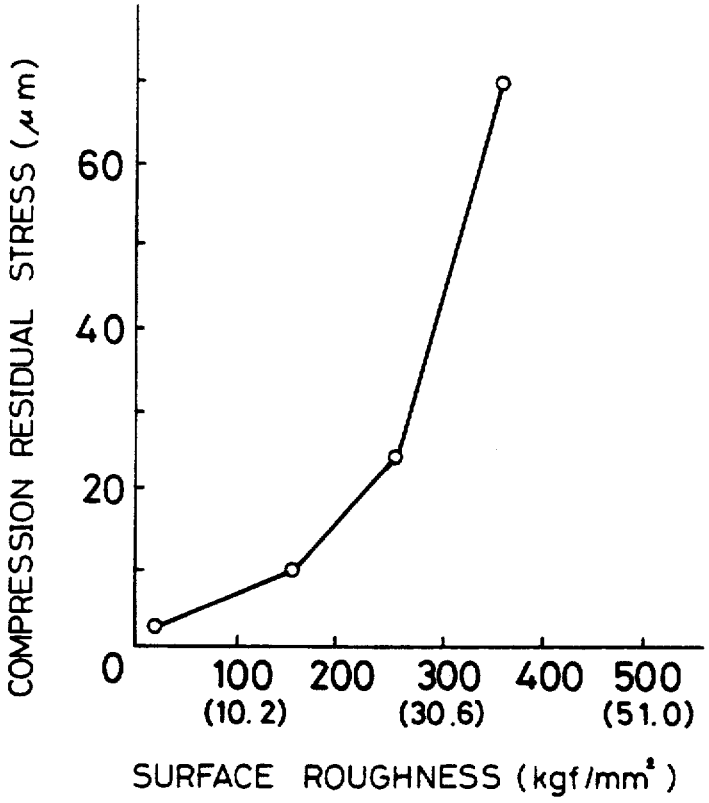
FIG. 6 is a graph showing that the compression residual stress generated by a conventional shot peening treatment in the aluminum alloy member and the surface roughness.

FIG. 5 shows the relation between the compression residual stresses caused by the shot peening treatments of Examples 1, 2, 3, and 4 in the reinforcement members and the increased compression residual stresses when the temperatures of the reinforcement members fall to room temperature (20°-25° C.).

In FIG. 5, Line 1 shows the shot peening treatment of Example 1, Line 2, the shot peening treatment of Example 2, Line 3, the shot peening treatment of Example 3, and Line 4, the rolling process of Example 4. As seen from the figure, the compression residual stresses, produced by light plastic working treatments on the reinforcement members carried out when they were in their respective softening states, ranged from 20 to 100 Mpa, however, they increased up to 100-300 MPa as the temperatures of the reinforcement members fell to room temperature.

Additionally, the strain distribution over the surface of the reinforcement member was measured with a strain gauge. It was confirmed that the greater the compression residual stress is, the wider the strain distribution (or the development zone of the compression residual stress).

What is claimed is:

1. A surface reforming method for improving a fatigue strength of aluminum alloy members comprising the steps of:

(a) performing a shot peening treatment on a surface of an aluminum alloy member at its softening temperature, and (b) lowering the temperature of the aluminum alloy member on which the shot peening treatment has been performed, down to room temperature;

wherein the fatigue strength of the aluminum alloy member is increased without increasing a surface roughness of the surface of the aluminum alloy member.

2. The surface reforming method according to claim 1, wherein the temperature of the aluminum alloy member in performing the shot peening treatment is in the 50°-125° C. range.

3. The surface reforming method according to claim 1, wherein the temperature of the aluminum alloy member in performing the shot peening treatment is obtained during a cooling process of a tempering treatment of a solution treatment.

4. The surface reforming method according to claim 1, wherein the arc height in performing the shot peening treatment is in the 0.025–0.125 mm range.

* * * * *